US005692559A

United States Patent [19]

Cheong

[11] Patent Number: 5,692,559

[45] Date of Patent: Dec. 2, 1997

[54] PLATE HEAT EXCHANGER WITH IMPROVED UNDULATING PASSAGEWAY

[75] Inventor: Alex S. Cheong, Ontario, Canada

[73] Assignee: Long Manufacturing Ltd., Oakville, Canada

[21] Appl. No.: 488,001

[22] Filed: Jun. 7, 1995

[51] Int. Cl.[6] ..... F28D 1/03

[52] U.S. Cl. ..... 165/148; 165/153; 165/170

[58] Field of Search ..... 165/148, 153, 165/170, 78

[56] References Cited

U.S. PATENT DOCUMENTS

| | | | |
|---|---|---|---|
| 3,258,832 | 7/1966 | Gerstung | 165/148 X |
| 3,341,925 | 9/1967 | Gerstung | 165/148 X |
| 4,011,905 | 3/1977 | Millard | 165/153 X |
| 4,470,455 | 9/1984 | Sacca | 165/153 X |
| 4,696,342 | 9/1987 | Yamauchi et al. . | |
| 4,932,469 | 6/1990 | Beatenbough | 165/153 |
| 5,050,671 | 9/1991 | Fletcher | 165/148 X |
| 5,392,849 | 2/1995 | Matsunaga et al. | 165/78 X |

*Primary Examiner*—Leonard R. Leo
*Attorney, Agent, or Firm*—Barrigar & Moss

[57] ABSTRACT

A heat exchanger is disclosed having a plurality of stacked plate pairs with a core thickness of less than 25 mm. Each plate of a plate pair has asymmetrically arranged parallel ribs disposed at an oblique angle of less than 32 degrees to provide two point contact between the ribs on adjacent plate pairs.

10 Claims, 2 Drawing Sheets

PLATE HEAT EXCHANGER WITH IMPROVED UNDULATING PASSAGEWAY

BACKGROUND OF THE INVENTION

This invention relates to heat exchangers, and in particular, to oil coolers made up of stacked plate pairs defining flow passages therebetween.

DESCRIPTION OF THE PRIOR ART

In modern industries, such as the automotive industry, where heat exchangers are required, it has become very important to make the heat exchangers small or compact, with high heat exchange efficiency, low flow resistance, both internal and external, and low pressure drop in connection with the passage of fluids through the heat exchangers. One of the most promising constructions for accomplishing all of these desired results are the heat exchangers made up of stacked plate pairs. An example of such a heat exchanger is shown in U.S. Pat. No. 4,002,201 by the inventor Desmond M. Donaldson. The Donaldson patent shows the use of fins between the plate pairs, but these fins can be eliminated.

One way of eliminating the fins between the plate pairs is to cause the planar surfaces of the plates forming the plate pairs to be undulated or dimpled. These undulations or dimples perform two primary functions, namely, to improve the heat transfer characteristics of the plates, and to support and facilitate the bonding of the plates together so that the heat exchanger can withstand the internal pressures to which it may be subjected.

The present invention is related to the stacked plate pair type heat exchanger having undulated plates forming the plate pairs, and in particular, to plates which have obliquely orientated ribs or valleys formed therein. Typically, two symmetrical plates are put together to form a plate pair with the valleys or ribs of one plate crossing the valleys or ribs of the other plate in a criss-cross fashion. A difficulty with the crossing rib plate pair type heat exchangers produced in the past, however, is that they are difficult to manufacture, especially if the plates are formed of aluminum. The problem is that the crossing ribs do not mate in an ideal fashion resulting in the plate pairs rocking or shifting during the process of bonding the plates and the plate pairs together. This results in non-uniform bonding with a reduction in the strength of the heat exchanger or even defects, such as leaks. In extreme cases, manufacturing tolerances cannot be maintained to satisfactory levels.

SUMMARY OF THE INVENTION

The present invention employs an improved rib design which overcomes many of the manufacturing difficulties of the prior art, with the surprising result of an improvement in the performance of the heat exchanger as well.

According to the invention, there is provided a stacked plate heat exchanger comprising a plurality of stacked plate pairs. Each plate pair includes first and second plates having peripheral edge portions joined together and central planar portions spaced apart to define a fluid passage therebetween. Each plate pair has spaced-apart inlet and outlet openings, the openings being connected together for the flow of fluids through the fluid passages. The central planar portions have obliquely orientated, parallel ribs formed therein, said ribs being arranged asymmetrically on each plate of a plate pair, so that in back-to-back plates of adjacent plate pairs each rib on one plate contacts no more than two ribs on an adjacent plate of said back-to-back plates.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
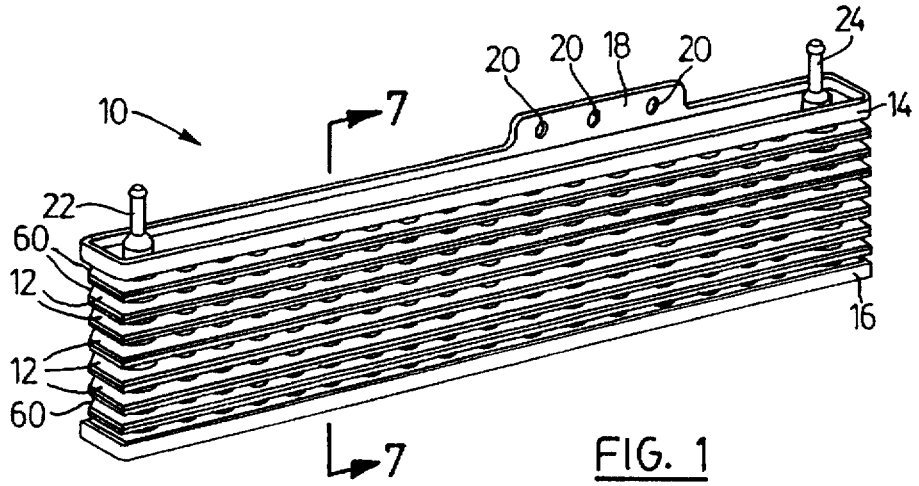
FIG. 1 is a perspective view of a preferred embodiment of a stacked plate heat exchanger according to the present invention.
Figure 2:
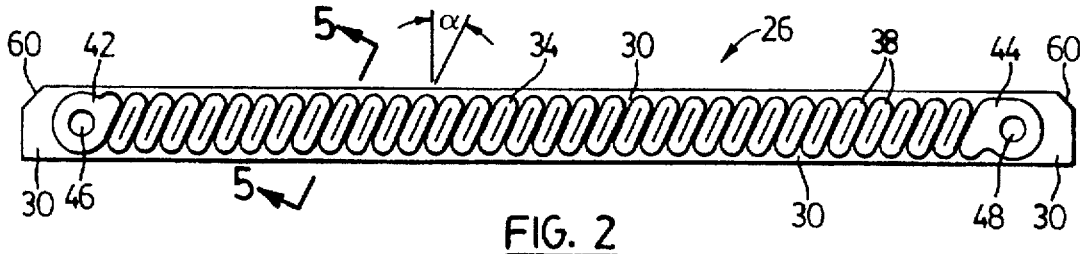
FIG. 2 is a plan view of one plate of each plate pair.
Figure 3:
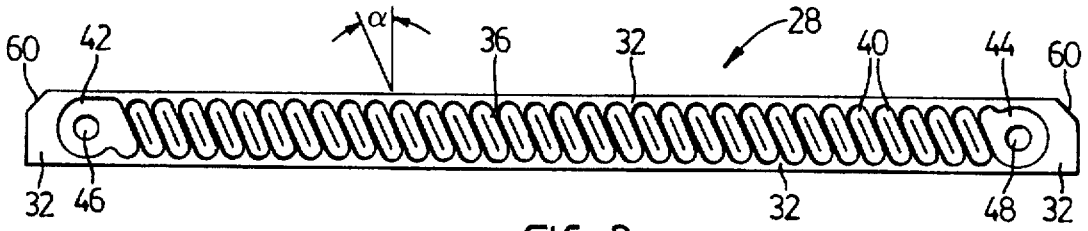
FIG. 3 is a plan view of the second plate of each plate pair.

Referring firstly to FIGS. 1 to 3, a preferred embodiment of a heat exchanger according to the present invention is generally indicated in FIG. 1 by reference numeral 10. Heat exchanger 10 is formed of a plurality of stacked plate pairs 12, an upper support channel 14 and a lower support channel 16. Upper support channel 14 has an upright flange 18 with mounting holes 20 for mounting heat exchanger 10 in a desired location. Upper and lower support channels 14, 16 are not essential to heat exchanger 10 and may be eliminated if desired. Similarly, upright flange 18 may be replaced by any other suitable arrangement for mounting heat exchanger 10.

In an automotive application, heat exchanger 10 is typically used for cooling engine or transmission oil and is usually mounted in front of the normal radiator which is part of the engine cooling system. Inlet and outlet nipples 22, 24 are mounted in upper support channel 14 and are connected to supply and return oil lines (not shown) for the passage of the oil to be cooled through heat exchanger 10. Air passes transversely through heat exchanger 10 between the plate pairs to cool the oil passing through heat exchanger 10.

FIGS. 2 and 3 show the preferred embodiments of the plates which make up each plate pair 12. FIG. 2 shows a first plate 26 which could be a top plate, and FIG. 3 shows a second plate 28 which could be a bottom plate. Plates 26, 28 have peripheral edge portions 30, 32 which are joined together respectively to form plate pairs 12. Plates 26, 28 also have central planar portions 34, 36 (see FIG. 5) which are spaced apart to define a fluid passage between the plates. Actually, central planar portions 34, 36 are formed with a plurality of obliquely orientated, parallel ribs 38, 40. In FIG. 2, first plate 26 is viewed showing the outer surface, so that ribs 38 are coming out of the page. In FIG. 3, second plate 28 is viewed showing the inside surface, so that ribs 40 are going into the page. In FIG. 3, ribs 40 would actually appear as valleys or grooves in second plate 28. First plate 26 is placed on top of second plate 28 to form one of the plate pairs 12.

Plates 26, 28 are also formed with end bosses 42, 44 which define respective inlet openings 46 and outlet openings 48. When plate pairs 12 are stacked, all of the inlet openings 46 are in registration and communicate with inlet nipple 22, and all of the outlet openings 48 are in registration and communicate with outlet nipple 24. In this way, all of the end bosses 42 form an inlet manifold and all of the end bosses 44 form an outlet manifold so that fluid flows in parallel through all of the plate pairs 12. However, it will be appreciated that some of the inlet openings 46 and some of the outlet openings 48 could be selectively closed or omitted, as will be appreciated by those skilled in the art, so that fluid could be made to flow in series through each of the plate pairs 12, or in some series/parallel combination.

The ribs 38, 40 in each plate 26, 28 are arranged asymmetrically. That is, the ribs 38 in plate 26 are located closer to inlet opening 46 than they are to outlet opening 48. Similarly, ribs 40 in plate 28 are located closer to outlet opening 48 than they are to inlet opening 46. The purpose of this will be described further below. Plates 26, 28 are, however, identical, in that if either plate were to be turned over and rotated 180 degrees they would look the same.

Figure 4:
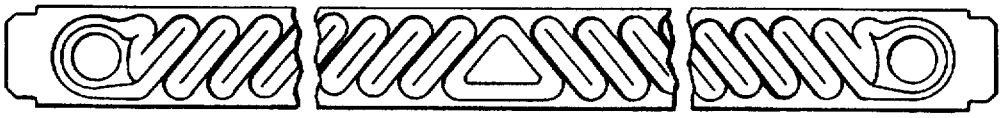
FIG. 4 (PRIOR ART)
FIG. 4 is a plan view of a typical prior art plate used to make the plate pairs of a stacked plate pair heat exchanger.
Figure 6:
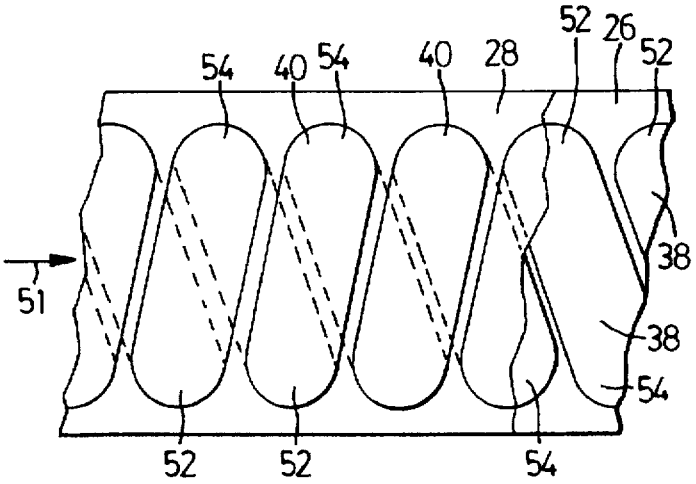
FIG. 6 is an enlarged plan view of a portion of a plate pair showing the crossing of the ribs on the mating plates.
Figure 8:
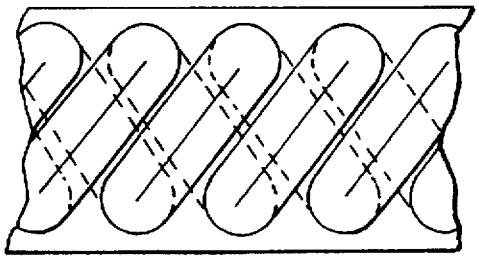
FIG. 8 (PRIOR ART)
FIG. 8 is a plan view similar to FIG. 6 but showing the rib crossing pattern of the prior art plate shown in FIG. 4.

Referring next to FIG. 6, a lower or second plate 28 of one plate pair 12 is shown stacked on top of an upper or first plate 26 of a second plate pair 12. From this, it will be seen that the back-to-back plates of adjacent plate pairs are arranged such that each rib on one plate contacts no more than two ribs on an adjacent plate of these back-to-back plates. In other words, when oil flows through the plates in the direction of arrow 51, each rib has an upstream end 52 and a downstream end 54, the upstream ends 52 of the ribs on one plate are in contact with the downstream ends 54 of the ribs on the adjacent plate of each of the back-to-back plates. This is referred to as two point contact of the ribs on adjacent plates. In contrast, in the prior art plates shown in FIGS. 4 and 8, each rib on one plate contacts three ribs on the adjacent plate resulting in a three point contact between the ribs on adjacent plates. Another distinction is that in the prior art plates as shown in FIG. 4, the ribs are symmetrically arranged.

The three point contact of the prior art plates causes problems in manufacture, because it is difficult to make contact at all three points. Also, as the punch and die sets that are used to make the plates wear down the ribs tend to get shorter or the ends more round with the result that the ribs end up making contact only at the centre points. The two point contact as shown in FIG. 6 overcomes these difficulties.

Figure 5:
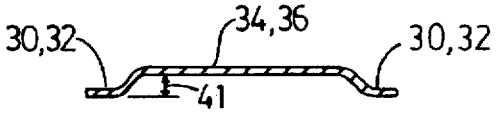
FIG. 5 is a sectional view taken along lines 5—5 of FIG. 2.

Referring again to FIGS. 2 and 3, ribs 38, 40 are orientated at an oblique angle $\alpha$ between 18 and 32 degrees. The preferred range is between 20 and 24 degrees. The transverse width of plates 26, 28 is preferably between 15 and 25 mm. For a width of 20 mm, the preferred angle $\alpha$ is about 24 degrees, and for a width of about 25 mm, the preferred angle is about 18 degrees. Plates 26, 28 are preferably formed of brazing clad aluminum of a thickness between 0.3 and 1.5 mm. The inside rib height 41 as shown in FIG. 5 is preferably less than 7 mm.

Figure 7:
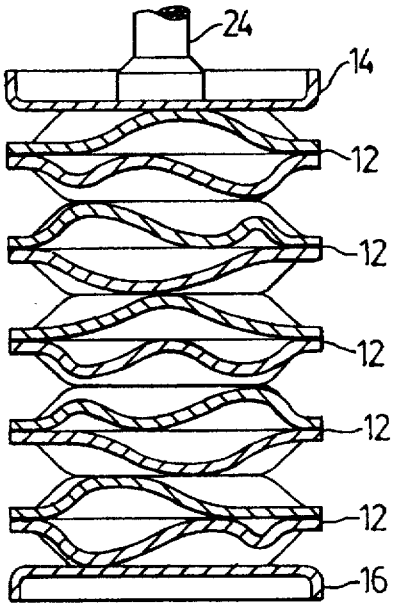
FIG. 7 is a sectional view taken along lines 7—7 of FIG. 1.
Figure 9:
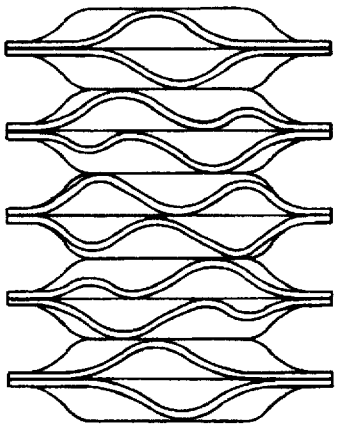
FIG. 9 (PRIOR ART)
FIG. 9 is a vertical sectional view similar to FIG. 7, but showing stacked plate pairs made up of the prior art plates of FIG. 4.

Referring next to FIG. 7 in comparison with the prior art configuration shown in FIG. 9, the cross-sectional flow area inside plate pairs 12 is about 17% larger for the same rib height as it is in the prior art configuration shown in FIG. 9. Also, the variation in the size of the flow openings is also smaller than in the FIG. 9 prior art embodiment. The result is that there is less oil slide flow resistance and pressure drop in plate pairs 12 than there is in the prior art configuration.

In the assembly of heat exchanger 10, plates 26, 28 are arranged into stacked plate pairs producing the two point rib contact as shown in FIG. 6. In doing this, plates 26, 28 have to be orientated properly, or inlet openings 46 and outlet openings 48 will not line up. If this occurs, it can be corrected simply by turning one of the plates 26, 28 end for end. This occurs because plates 26, 28 are asymmetrical as mentioned above. In order to assist in the proper orientation of plates 26, 28 during assembly, one or more of the corners 60 of the plates could be chamfered or marked in some other way, so that the orientation marks line up as the plates are stacked. If both corners are chamfered on one side of each plate, alignment is done simply by lining up all the chamfered corners on all the plate pairs as indicated in FIG. 1. As the plate pairs 12 are stacked, upper and lower support channels 14 and 16 are also put into position. The plates are then brazed together to complete heat exchanger 10.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

What is claimed is:

1. A stacked plate heat exchanger comprising: a plurality of stacked plate pairs, each plate pair including first and second plates having peripheral edge portions joined together and central planar portions spaced apart to define a fluid passage therebetween; each plate pair having spaced-part inlet and outlet openings, said openings being connected together for the flow of fluid through said fluid passages; the central planar portions having a plurality of obliquely orientated, parallel ribs formed therein, said ribs being arranged asymmetrically on each plate of a plate pair, so that the plurality of ribs are located closer to one of the inlet and outlet openings than they are to the other of the inlet and outlet openings; in back-to-back plates of adjacent plate pairs each rib on one plate contacts no more than two ribs on an adjacent plate of said back-to-back plates.

2. A heat exchanger as claimed in claim 1 wherein the ribs have upstream and downstream ends, and wherein the upstream ends of the ribs on one plate contact the downstream ends of the ribs on the adjacent plate of said back-to-back plates.

3. A heat exchanger as claimed in claim 1 wherein the ribs are orientated at an oblique angle between 18 and 32 degrees.

4. A heat exchanger as claimed in claim 1 wherein the transverse width of the plates is between 16 and 25 mm.

5. A heat exchanger as claimed in claim 1 wherein the ribs are orientated at an oblique angle between 20 and 24 degrees, and the transverse width of the plates is about 20 mm.

6. A heat exchanger as claimed in claim 5 wherein the oblique angle is about 18 degrees and the transverse width of the plates is about 25 mm.

7. A heat exchanger as claimed in claim 5 wherein the plates are formed of aluminum.

8. A heat exchanger as claimed in claim 7 wherein the plates are formed of aluminum of thickness between 0.4 and 0.8 mm and wherein the rib height is less than 7 mm.

9. A heat exchanger as claimed in claim 1 wherein the plates include orientation marks for alignment of the asymmetrically arranged ribs on the first and second plates.

10. A heat exchanger as claimed in claim 9 wherein the orientation marks are chamfered corners formed on one side of each plate.

* * * * *